United States Patent [19]

Kaelin

[11] Patent Number: 5,043,957

[45] Date of Patent: Aug. 27, 1991

[54] WATCH COMPRISING MEANS FOR LATERAL POSITIONING OF THE MOVEMENT IN THE WATCH CASE

[75] Inventor: Laurent Kaelin, Bienne, Switzerland

[73] Assignee: ETA SA Fabriques d'Ebauches, Switzerland

[21] Appl. No.: 509,151

[22] Filed: Apr. 16, 1990

[30] Foreign Application Priority Data

May 3, 1989 [CH] Switzerland ..... 01679/89

[51] Int. Cl.[5] ..... G04B 37/00

[52] U.S. Cl. ..... 368/300; 368/314

[58] Field of Search ..... 368/316, 297, 298, 300, 368/314, 317

[56] References Cited

U.S. PATENT DOCUMENTS

| | | | |
|---|---|---|---|
| 3,633,356 | 1/1972 | Kitazima et al. | 368/316 |
| 4,184,417 | 1/1980 | Kanda et al. | 368/316 |
| 4,558,957 | 12/1985 | Mock et al. . | |
| 4,648,722 | 3/1987 | Mock et al. . | |

FOREIGN PATENT DOCUMENTS

| | | |
|---|---|---|
| 1908993 | 1/1965 | Fed. Rep. of Germany . |
| 58719 | 2/1912 | Switzerland . |
| 271428 | 1/1951 | Switzerland . |
| 280558 | 5/1952 | Switzerland . |
| 647125 | 1/1985 | Switzerland . |
| 650894 | 8/1985 | Switzerland . |

*Primary Examiner*—Bernard Roskoski

*Attorney, Agent, or Firm*—Pollock, Vande Sande & Priddy

[57] ABSTRACT

The watch (1) in accordance with the invention comprises positioning means for the movement in the case. The positioning means comprise two blind holes (30) arranged in the case (6) and two centering elements (32), these latter having a first part driven into the blind holes and a second part (36) projecting from the case and cooperating with openings (38) provided in the movement.

22 Claims, 3 Drawing Sheets

WATCH COMPRISING MEANS FOR LATERAL POSITIONING OF THE MOVEMENT IN THE WATCH CASE

This invention concerns a watch comprising means for lateral positioning of the movement in the watch case, these means being more specifically intended to maintain the movement centered in the case in spite of the forces which may be applied thereto by the stem or the push-buttons during use of the watch, particularly in the case of watches of the chronograph type or watches having multiple functions.

BACKGROUND OF THE INVENTION

There is already known from patent document CH 650 894 a watch which exhibits a caseband provided with an annular shoulder and a crystal on which is provided an annular clamping surface. This assembly has been conceived in a manner such that when one secures the crystal to the case, a portion of the annular surface of the crystal comes to rest on the periphery of the dial which has been initially centered by a notch provided on its edge in order to immobilize the latter against the annular shoulder.

If these means provide an advantage in connecting the caseband and the crystal while positioning the dial, there nevertheless remains the fact that the movement must be maintained in all circumstances correctly positioned within the case, and such has not been suggested within this document.

Effectively, in the case of watches of the chronograph type having push-buttons, the push-button or push-buttons when actuated exert forces on the order of a kilogramme on the movement. Such forces tend then to bring about a lateral displacement of the movement in the case which, in the absence of lateral positioning means will, following a certain period of time, cause play in the positioning of the movement in the case which is detrimental to proper functioning of the chronograph. This phenomenon is accentuated in instances where the case is formed of a soft material such as plastic material.

Furthermore, the absence of such lateral positioning during the assembly of the movement in the case, because of the poor centering of the axis of the hands relative to the dial, risks distorting reading of the time and consequently spoiling the aesthetic aspect of the watch.

The invention thus has as its principal purpose to overcome these difficulties of the prior art as mentioned hereinabove in providing a watch in which the movement is laterally positioned in a simple and certain fashion within the watch case.

SUMMARY OF THE INVENTION

To this end, the invention has as objective a watch including a caseband and a back cover together forming a watch case, a movement and a dial arranged in such case and a crystal secured to the caseband to assure blocking of the movement and the dial in a direction perpendicular to the dial, the watch also comprising at least one control element for the movement acting mechanically thereon, centering means for the dial with respect to the case and lateral positioning means for the movement in the case.

In conformity with the invention, said lateral positioning means are associated with a centering element fixed to the case defining a lateral support for a complementary surface of the movement, this element being provided substantially in a zone diametrically opposite the axis of one of the control elements.

Thus, in view of these characteristics, the forces transmitted through the stem or the push-buttons are absorbed by the centering element and are without effect on the positioning of the movement. There results therefrom an increase in the reliability and the life duration of the watch.

Such characteristics are particularly interesting in the case of chronograph type watches having push-buttons and this particularly when the case is formed of a material of small rigidity such as plastic materials.

Furthermore, according to an alternative embodiment of the invention, the lateral positioning means comprise at least two centering elements fixed to the case, each defining a lateral support for a complementary surface of the movement. Preferably the positioning means are associated with two diametrically opposite blind holes provided in the case, the two centering elements having a first part driven into the blind holes and a second part projecting from the case and cooperating with openings provided in the movement.

Thus, when the movement is placed in the case, this latter is self-centering in fitting itself onto said projecting parts of the centering elements so that the movement is blocked at the same timein rotation and translation within the case, and one thus obtains thereafter a satisfactory maintenance of the movement in the case and good centering of the hands relative to the dial.

Other characteristics and advantages of the invention will appear upon reading the description which follows of an embodiment thereof given by way of non-limiting example and having reference to the attached drawings.

DESCRIPTION OF THE PREFERRED EMBODIMENT

Figure 1:
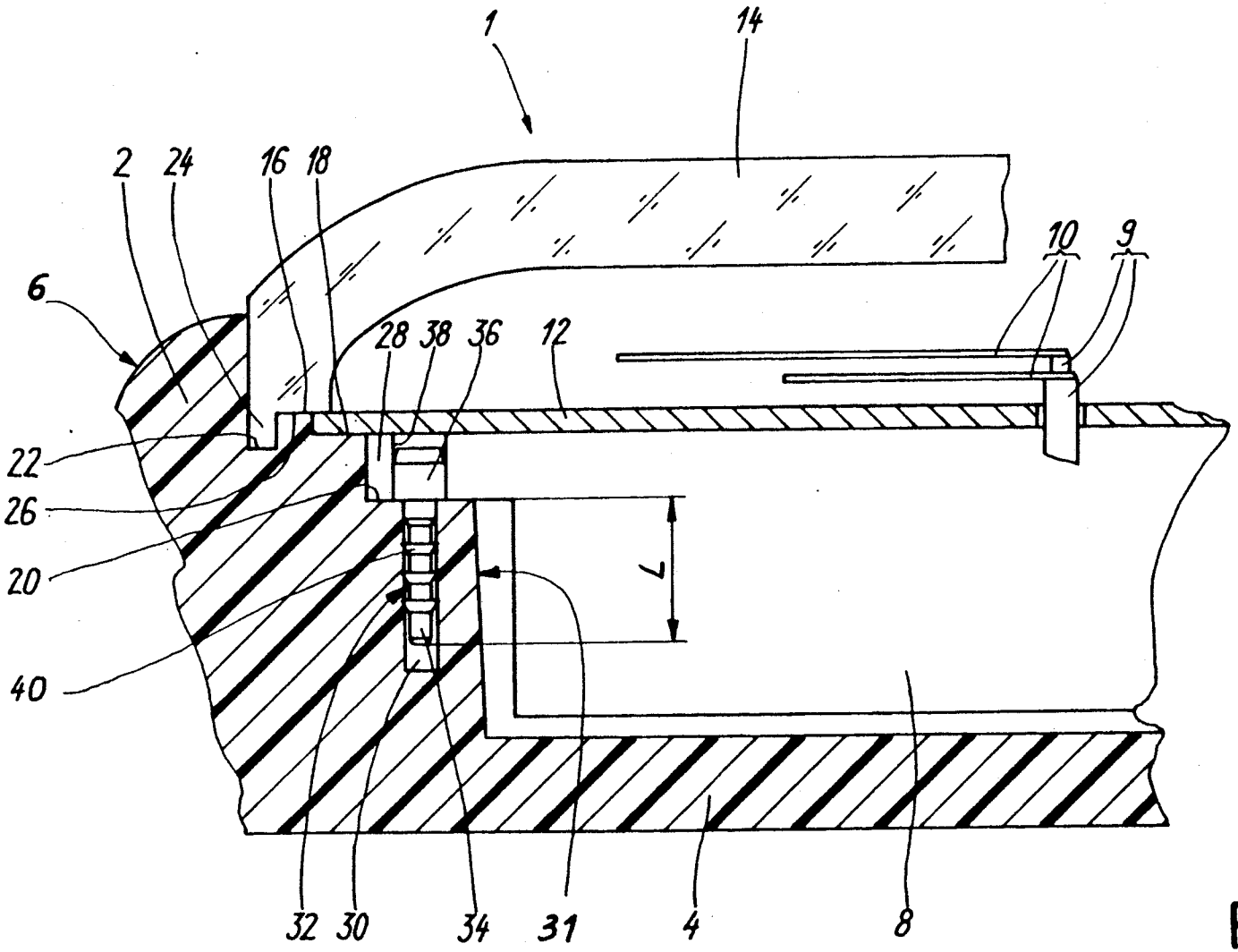
FIG. 1 is a partial cross-section view along line I—I (FIG. 2) of a watch provided with lateral positioning means of the movement in the case according to the invention.

In referring to the drawings one sees in a schematic form a watch of the chronograph type having push-buttons, for instance designated generally by reference numeral 1. Watch 1 comprises a caseband 2 and a back cover defining in this instance a case 6 formed in one piece. Case 6 contains in a standard manner a movement 8 from which project axes 9 for the hands 10 passing through a dial 12 and it is closed by a crystal 14.

In the example illustrated, case 6 and crystal 14 are formed of plastic materials which may be heat welded between themselves as has been precisely described in patent document CH 650 894.

The internal face of case 6 includes a plurality of shoulders 16, 18, 20 provided during the moulding in order to receive respectively the crystal 14, dial 12 and movement 8. Shoulder 16 receiving the crystal is completed by an annular groove 22 in which is housed and secure a rib 24 of the crystal.

Furthermore, crystal 14 comprises an annular clamping surface 26 supported partially on the peripheral edge of the dial in order to block it axially, i.e. in a direction perpendicular to the back cover 4. Moreover, movement 8 comprises a fillet 28 clamped between the lower face of the dial and shoulder 20 so that this latter is likewise axially blocked in the interior of the case.

As is well understood, the watch comprises in a standard manner centering means for the dial relative to the case. These means consist for instance of on or several notches 29 provided on the periphery of the dial and arranged to cooperate with corresponding catches provided on shoulder 18.

Figure 2:
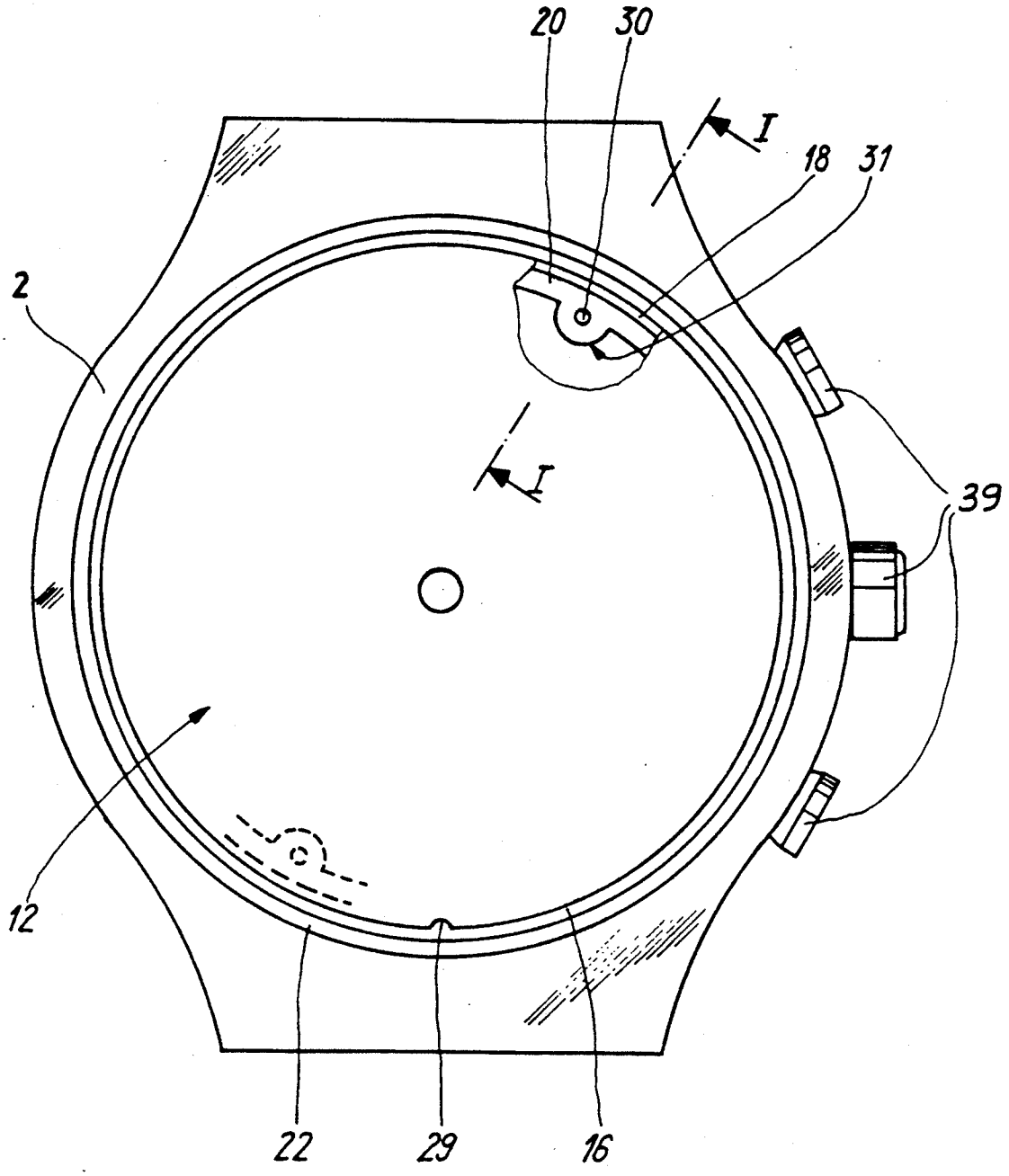
FIGS. 2 and 3 are views from above, partally broken away, of a watch according to FIG. 1, the crystal and hands having been omitted.

In a preferred embodiment of the invention (FIG. 2), the lateral positioning means of the movement in the case are associated on one hand with two blind holes 30 provided in the case. More precisely, shoulder 20 exhibits two projecting parts 31 (one of which is shown in dotted outline on the drawing), diametrically opposite one another and directed towards the interior of the case in manner such that each blind hole 30 may be partially arranged in the shoulder 20 and in the projecting portion 31.

Figure 3:
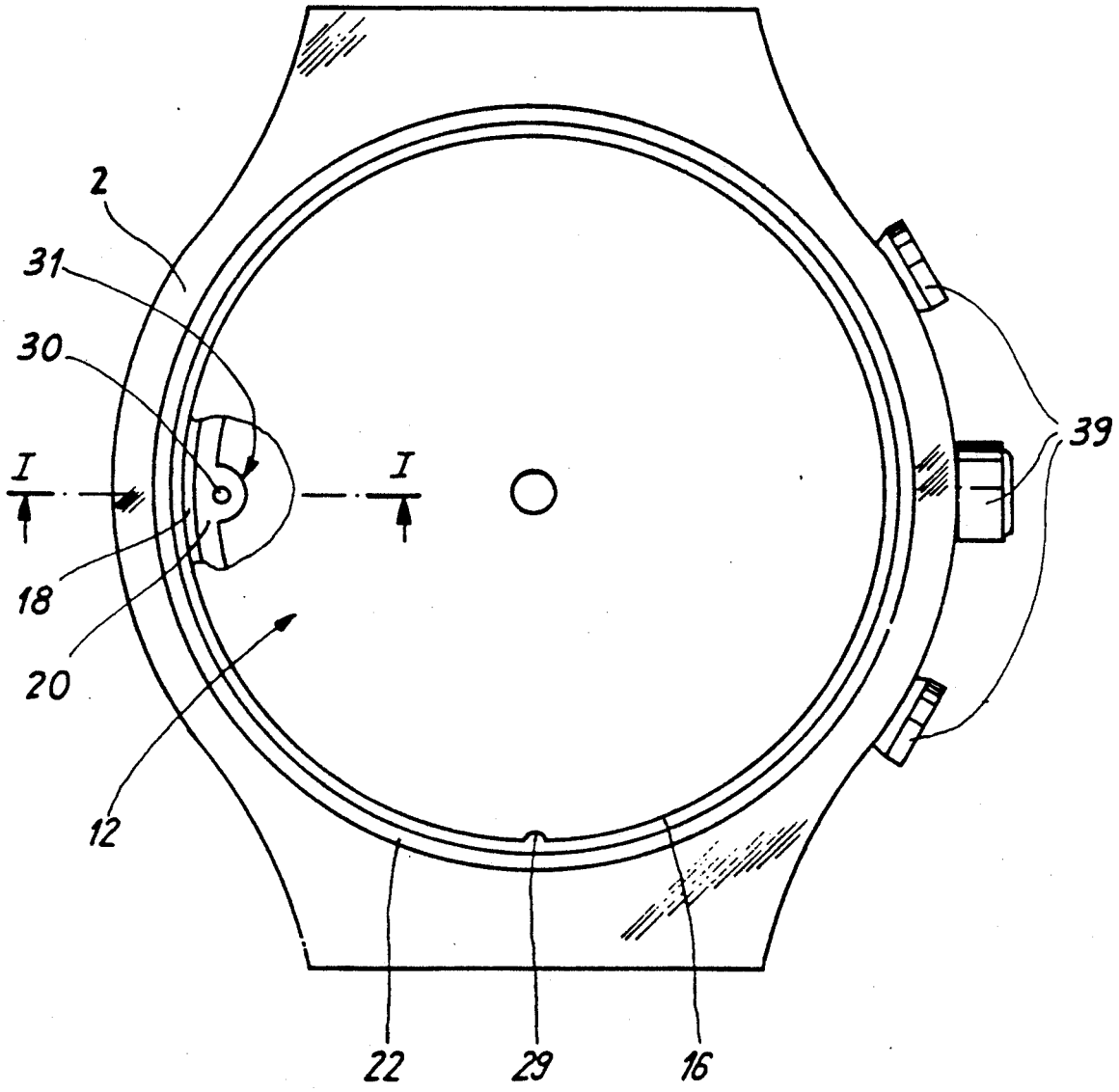

On the other hand, such positioning means comprise two centering elements 32 each having a first part 34 driven into hole 30 of the caseband and a second part 36 which projects from the surface of the supplementary shoulder in order to cooperate with openings 38 provided in fillet 28 of movement 8. On the other hand, in the variant shown on FIG. 3 the lateral positioning means comprise a single centering element such as described hereinabove, the latter being provided substantially within a zone diametrically opposite the axis of one of the control elements 39.

The centering elements 32 are advantageously formed of a material which is relatively harder than the material of case 6 in a manner such that these latter may be easily driven into the case.

In the example shown, the centering element are of metal and take the form of a stud. The stud comprises on one hand a cylindrical shouldered head 36 adjust slide in the openings 38. On the other hand, the stud comprises a stem 34 having a plurality of flanges provided in the manner of a harpoon. These flanges 40 show tapered form the large base of which directed toward the head of the stud exhibits a diameter greater than that of the stem and the small base directed towards the end of the stem exhibits the same diameter as that of the stem.

The utilization of stems including projection is justified more particularly in the example illustrated in which the case is of plastic material by reason of the mechanical properties of these latter. Effectively, the plastic material has an elasticity such that it prevents any satisfactory blocking of a smooth metallic stem which is simply driven in. It is for this reason, according to a characteristic of the invention, that when the stem provided with the projections penetrates into the case, these projections (harder than the case) elastically deform the plastic material which, when the stem is in position, adopts the form of the projections in view of its own elasticity, thus bringing about effective blocking of the stem in the case.

According to a variant embodiment of the centering elements, one could provide a screw having spaced deep threads in order to facilitate penetration of the latter in the case.

Preferably, the stem of the centering element has a length L comprised between 4 and 5 times the diameter of the holes in order to assure correct maintenance of the movement in position.

It will be noted that where one is concerned with a case formed of metal, the flanges provided on the centering elements are no longer necessary, a standard type pin driven into the case being suitable of use as a centering element.

What is claimed is:

1. A watch comprising:

a caseband and a back which together form a watchcase;

a movement and a dial arranged in said watchcase;

a crystal secured to the caseband, said crystal comprising a clamping shoulder, said caseband comprising shoulder means, and said movement and said dial being maintained fixedly in a direction perpendicular to the dial by being clamped against said shoulder means by the clamping shoulder of said crystal;

at least one control element for the movement, said control element extending along an axis through said caseband and being slidable therein to mechanically act on the movement;

means for centering the dial relative to the watchcase; and, lateral positioning means comprising a centering element fixed directly on a shoulder of said caseband shoulder means and protruding therefrom so as to define a lateral support for engaging a complementary surface of the movement to prevent translation of the movement within the watchcase, said centering element extending in a direction substantially perpendicular to the dial and being provided substantially within a zone diametrically opposite to the axis of said control element.

2. A watch as set forth in claim 1 wherein said positioning means further comprises a blind hole arranged in the caseband, the centering element having a first part driven into the blind hole and a second part projecting from the caseband cooperating with an opening provided in the movement.

3. A watch as set forth in claim 1 wherein the caseband is formed from a material softer than that employed for the centering element.

4. A watch as set forth in claim 1 wherein the centering element is a stud.

5. A watch as set forth in claim 4 wherein the caseband is formed from plastic material and the centering element is formed from metal.

6. A watch as set forth in claim 4 wherein the stud comprises, on the one hand, a stem having a plurality of projections arranged as on a harpoon and, on the other hand, a shouldered cylindrical head.

7. A watch as set forth in claim 2 wherein said caseband shoulder means comprises a plurality of shoulders on an internal face of the caseband for respectively receiving the crystal, the dial and the movement, the dial and the movement each being pressed against its respective shoulder by an annular clamping surface of said clamping shoulder of the crystal; and wherein the respective shoulder receiving the movement comprises a projecting part directed toward the interior of the watchcase and in which the blind hole is provided.

8. A watch as set forth in claim 7 wherein said movement has a fillet and wherein the opening is provided in the fillet.

9. A watch as set forth in claim 1 wherein the control element for the movement is a push button and wherein the movement is a chronograph movement.

10. A watch comprising:

a caseband and a back which together form a watchcase;

a movement and a dial arranged in said watchcase;

a crystal secured to the caseband, said crystal comprising a clamping shoulder, said caseband comprising shoulder means, and said movement and said dial being maintained fixedly in a direction perpendicular to the dial by being clamped against said shoulder means by the clamping shoulder of said crystal;

at least one control element for the movement, said control element extending along an axis through said caseband and being slidable therein to mechanically act on the movement;

means for centering the dial relative to the watchcase; and, lateral positioning means comprising at least tow centering elements each fixed directly on a corresponding shoulder portion of said caseband shoulder means and protruding therefrom to define a lateral support for engaging a corresponding complementary surface of the movement to prevent both rotation and translation of the movement within the watchcase, each of said centering elements extending in a direction substantially perpendicular to the dial.

11. A watch as set forth in claim 10, wherein the two centering elements are arranged substantially within diametrically opposite zones.

12. A watch as set forth in claim 10 wherein the positioning means further comprise two blind holes provided in the caseband, the two centering elements having a first part driven into the blind holes and a second part forming a projection from the caseband and cooperating with openings provided in the movement.

13. A watch as set forth in claim 10, wherein the case is formed of a material which is softer than the material used for the centering elements.

14. A watch as set forth in claim 10, wherein the centering elements are studs.

15. A watch as set forth in claim 14 wherein the caseband is formed from plastic material and wherein the centering elements are formed from metal.

16. A watch as set forth in claim 14 wherein each stud comprises, on one hand, a stem having a plurality of projections arranged as on a harpoon and, on the other hand, a shouldered cylindrical head.

17. A watch case as set forth in claim 12 wherein said caseband shoulder means comprises a plurality of shoulders on an internal face of the caseband for respectively receiving the crystal, the dial and the movement, the dial and the movement each being pressed against its respective shoulder by an annular clamping surface of said clamping shoulder of the crystal; and wherein the respective shoulder receiving the movement comprises at least two projecting parts directed toward the interior of the watchcase and in each of which one of said blind holes is provided.

18. A watch as set forth in claim 17 wherein said movement has a fillet and wherein said openings are arranged in the fillet.

19. A watch as set forth in claim 10 wherein the control element for the movement is a push button and wherein the movement is a chronograph movement.

20. A watch as set forth in claim 11 wherein the positioning means further comprise two blind holes provided in the caseband, the centering elements having a first part driven into the blind holes and a second part forming a projection from the case and cooperating with openings provided in the movement.

21. A watch caseband as set forth in claim 15 wherein each stud comprises, on one hand, stem having a plurality of projections arranged as on a harpoon and, on the other hand, a shouldered cylindrical head.

22. A watch comprising:

a caseband and a back which together form a watchcase;

a movement and a dial arranged in said watchcase;

a crystal secured to the caseband, said crystal comprising a clamping shoulder, said caseband comprising shoulder means, and said movement and said dial being maintained fixedly in a direction perpendicular to the dial by being clamped against said shoulder means by the clamping shoulder of said crystal;

at least one control element for the movement, said control element extending along an axis through said caseband and being slidable therein to mechanically act on the movement;

means for centering the dial relative to the watchcase; and, lateral positioning means comprising first centering means and second centering means, said first centering means comprising a centering element fixed directly on a shoulder of said caseband shoulder means and protruding therefrom in a direction substantially perpendicular to the dial so as to define a lateral support for a complementary surface of the movement, and said centering element engaging said complementary surface and said second centering means engaging another part of the movement to prevent both rotation and translation of the movement within the watchcase.

* * * * *

UNITED STATES PATENT AND TRADEMARK OFFICE

CERTIFICATE OF CORRECTION

PATENT NO. : 5,043,957

DATED : August 27, 1991

INVENTOR(S) : Laurent Kaelin

It is certified that error appears in the above-identified patent and that said Letters Patent is hereby corrected as shown below:

Column 4, line 38, after "caseband" insert --and--.

Column 5, line 17, change "tow" to --two--.

Column 6, line 20, before "stem" insert --a--.

Signed and Sealed this

Nineteenth Day of January, 1993

*Attest:*

DOUGLAS B. COMER

*Attesting Officer*

*Acting Commissioner of Patents and Trademarks*